United States Patent [19]

Eaton

[11] 4,269,054

[45] May 26, 1981

[54] BENDING METHOD

[75] Inventor: Homer L. Eaton, Leucadia, Calif.

[73] Assignee: Eaton-Leonard Corporation, Carlsbad, Calif.

[21] Appl. No.: 93,850

[22] Filed: Nov. 13, 1979

Related U.S. Application Data

[62] Division of Ser. No. 887,725, Mar. 17, 1978, Pat. No. 4,201,073.

[51] Int. Cl.[3] ..... B21D 7/04

[52] U.S. Cl. ..... 72/151; 72/155; 72/156

[58] Field of Search ..... 72/149, 151, 154–157, 72/159, 307, 310, 312, 313, 369, 458, 459

[56] References Cited

U.S. PATENT DOCUMENTS

| | | | |
|---|---|---|---|
| 1,935,604 | 11/1933 | Abramson et al. | 72/154 |
| 2,871,909 | 2/1959 | Bower | 72/321 |
| 3,276,235 | 10/1966 | Stanley | 72/149 |
| 3,531,963 | 10/1970 | Garner et al. | 72/310 X |
| 4,022,045 | 5/1977 | Riha | 72/310 X |
| 4,059,978 | 11/1977 | Dettling | 72/156 |
| 4,063,441 | 12/1977 | Eaton | 72/151 |
| 4,085,608 | 4/1978 | Franks et al. | 72/297 |

FOREIGN PATENT DOCUMENTS

| | | | |
|---|---|---|---|
| 1962590 | 6/1971 | Fed. Rep. of Germany | 72/157 |
| 618737 | 3/1927 | France . | |

*Primary Examiner*—Ervin M. Combs

*Attorney, Agent, or Firm*—Gausewitz, Carr, Rothenberg & Edwards

[57] ABSTRACT

A rotary pipe bending machine employs a single hydraulic motor to drive clamp and pressure dies toward the bend die and to rotate the bend and clamp dies. The motor piston is connected via a chain to drive a clamp die carrier toward a rotatably mounted bend die and toward a bend die shaft actuator. Upon continued motion of the clamp die carrier, it engages the actuator to rotate the bend die together with a clamp die mounted on the carrier. The motor cylinder is movably mounted and connected to a pressure die carrier so that as the motor piston drives the clamp die carrier and the bend die, the cylinder, reacting to the driving force of the piston, drives the pressure die carrier, together with a pressure die thereon, toward the bend die with a force that is produced by reaction to the required bending force. Thus the pipe is frictionally tensioned according to the magnitude of the bending force. Two sets of dies are provided, one on each end of the bend shaft to enable pipe to be bent on either side of the bend head.

11 Claims, 15 Drawing Figures

FIG. 1.
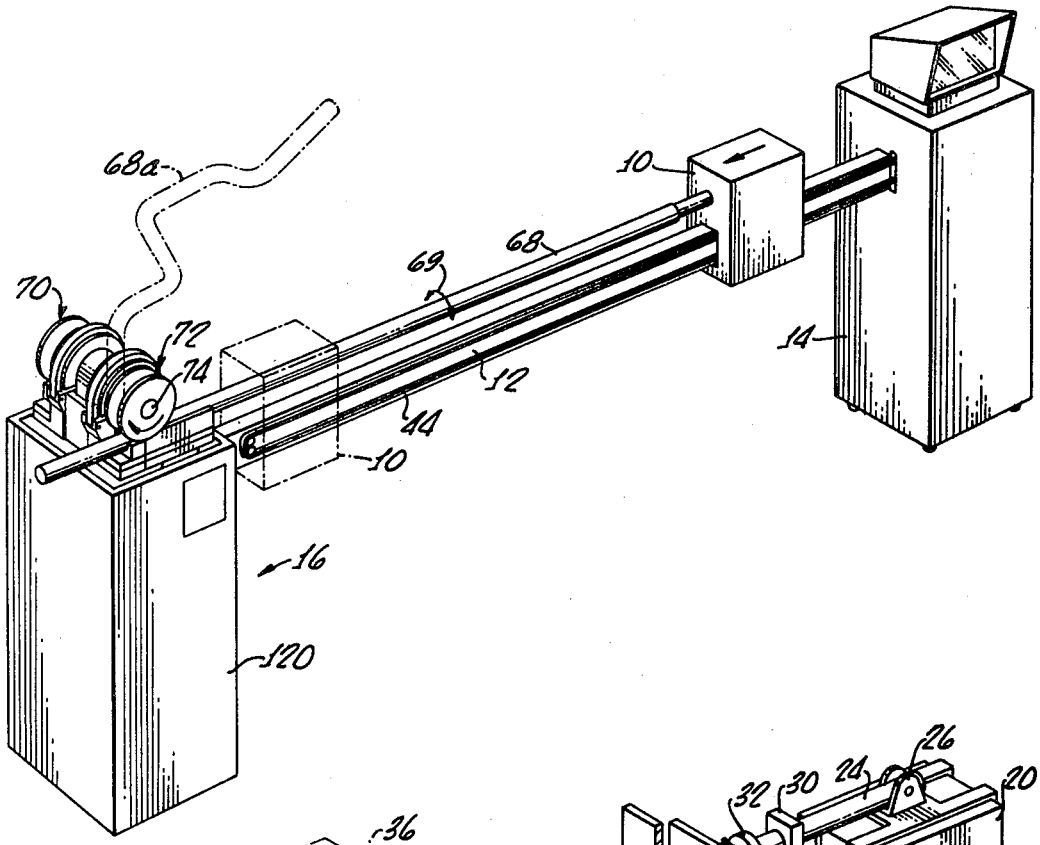
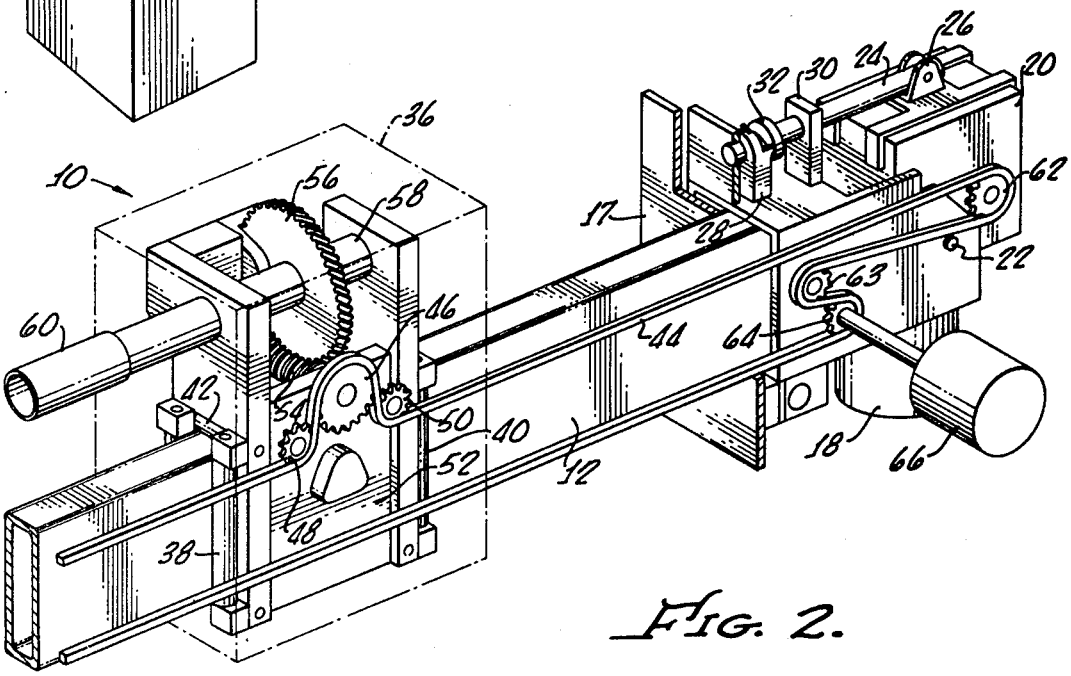
FIG. 2.

FIG. 6.
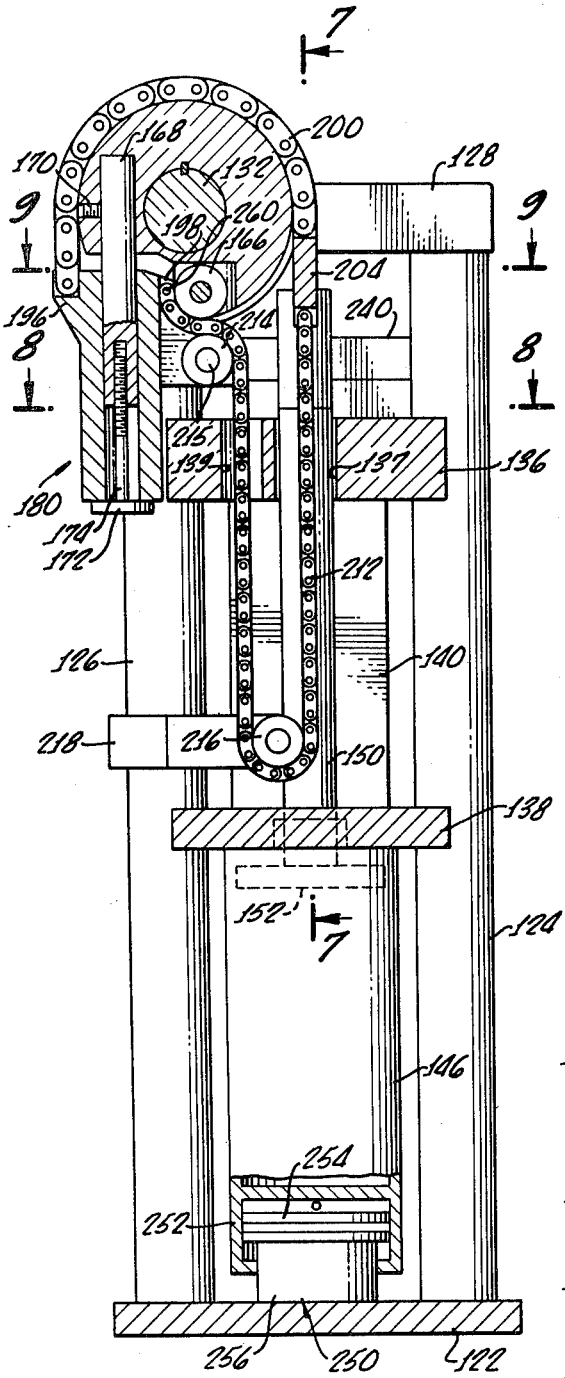
FIG. 7.
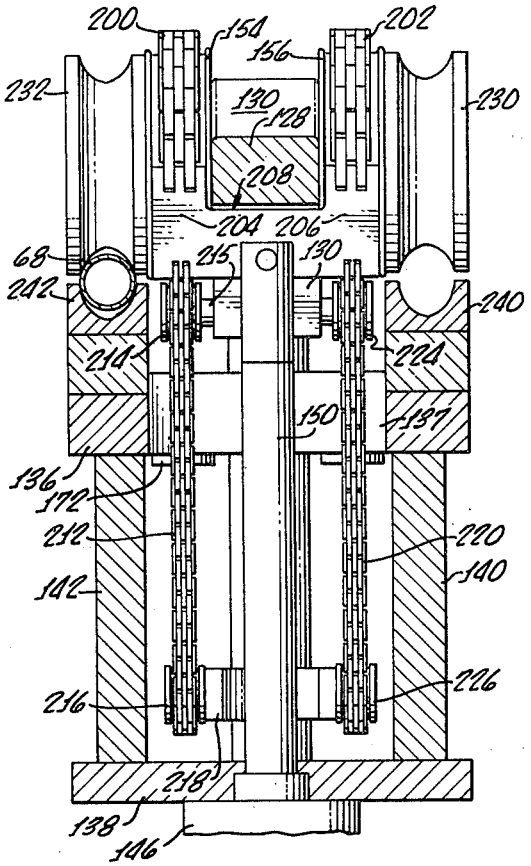
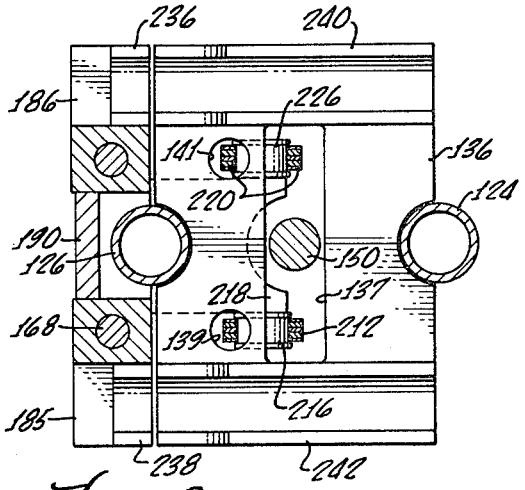
FIG. 8.

BENDING METHOD

This is a division of application Ser. No. 887,725, filed Mar. 17, 1978, now U.S. Pat. No. 4,201,073.

BACKGROUND OF THE INVENTION

Rotary pipe bending apparatus commonly employs a bend die mounted for rotation about a bend axis, a clamp die mounted for motion toward the bend die to clamp a pipe against the bend die, and a pressure die that is urged toward the bend die to press a rearward portion of the pipe to be bent against the bend die. Machines of this type are illustrated, for example, in U.S. Pat. No. 3,974,676 and several of the patents referred to therein, and in my co-pending applications Ser. No. 692,585, filed June 3, 1976 for Apparatus for Bending Tube and its parent application Ser. No. 614,946, filed Sept. 19, 1975 for Method and Apparatus for Bending Tube, now abandoned. The disclosures of these applications are fully incorporated herein by this reference. In general, in rotary pipe bending machines of this class, a pipe initially positioned at the bend die is clamped against the bend die by driving a clamp die toward the bend die under the force of a clamp die hydraulic cylinder. A pressure die hydraulic cylinder is operated to drive the pressure die toward the pipe and the bend die, and a third hydraulic cylinder, the bending cylinder, is operated to rotate the bend die together with the clamp die around the bend axis. The pipe, clamped between the clamp and bend dies, is pulled and bent around the bend die and a rearward portion of the pipe is restrained by the pressure die. The pressure die is often operated to create friction between the pipe and the pressure die (which presses the pipe against the bend die), in a so-called "wiping" action, such that an axial restraint is exerted on the pipe sufficient to stretch it beyond its yield, to thereby provide a drawing action. Draw bending, which stretches the outside of the pipe bend, is employed to avoid buckling of the pipe wall that may occur in simple compression or pressure bending, where the pipe is bent without such stretching. In many cases the pressure die is driven forwardly, as the pipe is bent around the bend die, by a fourth hydraulic cylinder, often termed a boost cylinder. This may control the amount of stretch. The clamp die presses the pipe against the bend die with a force sufficient to prevent slippage of the pipe relative to the clamp die during the draw forming.

Control of the pressure die is important for proper bending. Drawing, necessarily employed to accomplish many types of bending, is controlled in part by pressure exerted by the pressure die. Forces applied to the pipe during bending vary with the nature of the pipe to be bent, its size and material and other factors. Thus it is common to provide one or more gages to monitor pressures being exerted, such as the force exerted by the pressure die, for example, in an attempt to control the pressure die force relative to the bending force required for a particular bend being made. It is difficult and time-consuming to adjust the various forces to optimum values and, moreover, such optimum values may not always be known or readily available.

In prior rotary bending machines use of three or more separate hydraulic or other kinds of motors has greatly increased complexity and costs, with a consequent decrease in reliability and life of the machines.

Single motors are employed in press bending where a ram is driven against an intermediate portion of a pipe that is restrained at opposite sides of the ram by a pair of wing dies.

The U.S. Pat. No. to Garner et al 3,531,963 describes a type of press bending in which one hydraulic motor is employed to bend a pipe but does not mount auxiliary dies to move toward the bend die, does not drive the dies to press the pipe toward the bend die, and does not suggest draw forming.

The ability to make both right hand and left hand bends generally requires expensive and time-consuming tooling changes. U.S. Pat. No. 3,017,917 to Street shows an attempt to minimize such tooling change time and labor, but with the added burden of a complex 180° rotation of the entire bend head.

Accordingly, it is an object of the present invention to provide improved methods and apparatus for rotary pipe bending that eliminate or minimize above-mentioned problems.

SUMMARY OF THE INVENTION

In carrying out principles of the present invention, in accordance with a preferred embodiment thereof, a machine wherein a member to be bent is clamped between bend and clamp dies and pressed against a backup member by a pressure die while the bend and clamp dies are rotated by a rotation driving force, is operated by driving the pressure die toward the backup member with a force that is a function of the rotation driving force. In certain arrangements this enables draw bending with an axial tension that is a function of applied bending force. In a specific embodiment the force on the pressure die is derived from a reaction to the rotation driving force.

According to a further feature of the invention, a single motor is connected to drive both the bend and clamp dies, driving the clamp die toward the bend die and rotating the two together. A lost motion connection is provided between the motor and the bend die so that the clamp die will be moved toward the bend die before the two are rotated by the motor.

According to still another feature of the present invention, first and second bend die assemblies are mounted for rotation about a bend axis and a pipe feeding carriage for advancing the pipe toward the dies and for rotating the pipe about the pipe axis is selectively mounted for motion along either one of first and second carriage paths that are aligned respectively with the first and second bend arm assemblies. Thus the one bending machine can readily accommodate either right hand or left hand bends.

BRIEF DESCRIPTION OF THE DRAWINGS

FIG. 1 is a perspective view of a bending machine embodying principles of the present invention;

FIG. 2 is a simplified pictorial illustration, with parts broken away, of portions of the bending machine track, the pipe feeding carriage and the carriage drive;

FIG. 6 is a section taken on lines 6—6 of FIG. 5;

FIG. 7 is a section taken on lines 7—7 of FIG. 6;

FIGS. 8 and 9 are sections taken on lines 8—8 and 9—9 respectively of FIG. 6;

DETAILED DESCRIPTION

Figure 3:
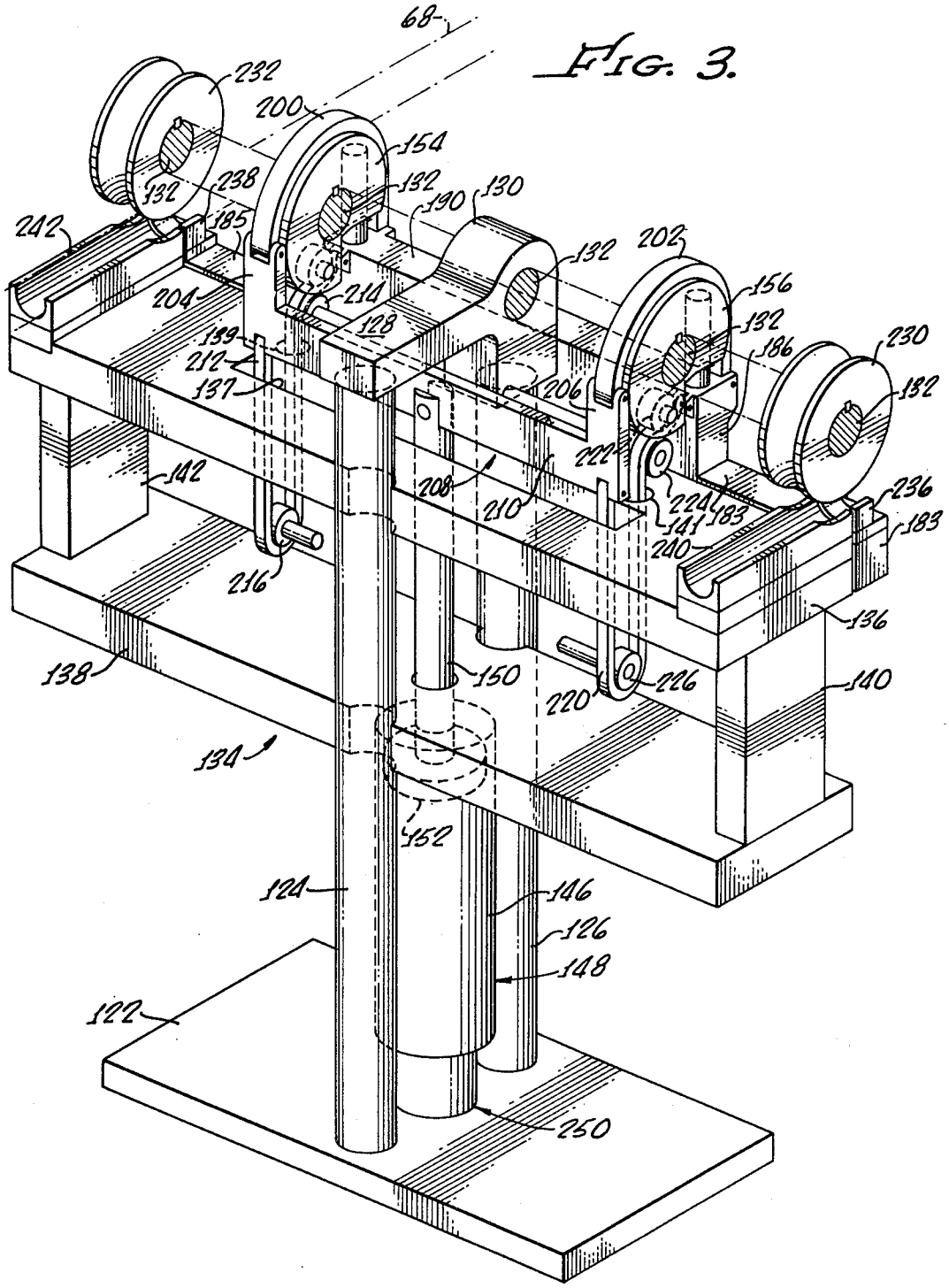
FIG. 3 is a simplified perspective view, laterally expanded for purposes of illustration, showing the major components of a bending head embodying principles of the present invention.

Illustrated in FIG. 1 is a pipe bending machine embodying principles of the present invention and including a pipe feeding carriage 10 slidably mounted on a carriage track 12 that is supported at one end upon a control console 14 and at the other end upon a bending head support 16. Control console 14 includes various controls for the apparatus, which controls may be manual or, as in a presently preferred form, digital controls responsive to recorded digital information in the form of punched tape, magnetic tape, magnetic discs, punch cards, or similar type of record media capable of bearing control information.

As shown in FIG. 2, the track 12 is a substantially rectangular beam having an end fixed to and extending through a front wall 17 of console 14 and having a motor 18 and gear box 20 mounted thereto for pivotal motion on a shaft 22. The pivotal position of the motor and the gear box 20 is adjustably maintained by means of a rod 24 pivoted to a pair of upstanding ears 26 on the gear box 20 and adjustably retained between a pair of upstanding posts 28, 30, fixed on the end of the track 12, by means of a spring urged locking tilt washer 32.

The carriage drive, which is fundamentally similar to the carriage drive described in my prior U.S. Pat. No. 3,974,676, for Tube Bending Machine and Carriage Therefor, includes a carriage housing 36 mounting a plurality of vertical roller guides, such as guides 38, 40, which engage sides of the track 12 at front and rear of the carriage, and horizontal roller guides, such as a roller guide 42 and a similar roller guide (not shown) at the rear of the carriage, whereby the carriage is freely slidable along the length of the track. A carriage drive chain 44 is entrained over and captured between a main drive gear 46 that is interposed between auxiliary gears 48, 50, all rotatably mounted on a carriage side wall 52. Main drive gear 46 drives a worm gear 54 that meshes with a chuck drive gear 56 which is fixed to and rotates a chuck shaft 58. A conventional pipe grasping chuck 60 is mounted on the shaft 58. Suitable selectively operated brakes (not shown) are provided to selectively restrain either rotation of the chuck shaft 58 or the slidable motion of the carriage relative to the track, so that rotation of the main gear 46 will either drive the carriage along the track or rotate the chuck, depending upon which of the brakes is operated, all as described in my U.S. Pat. No. 3,974,676.

Gear box 20 drives an output gear 62 which, together with a pair of idler gears 63, 64, are all mounted on the end of track 12. Endless chain 44 is entrained over the gears 62, 63 and 64, has its tension adjusted by the pivotal position of the motor and gear box about pivot shaft 22, and accordingly will either rotate gear 46 (to rotate the chuck) or drive the carriage along the track, depending upon which of the brakes is actuated.

The carriage is movable between a rearward position such as the position illustrated in solid lines in FIG. 1 and a forward position illustrated in dotted lines. A pipe 68 is grasped by the chuck and rotated as indicated by arrow 69 in one direction or the other to achieve a predetermined plane of bend. The carriage is advanced toward the bend head support to position the pipe 68 relative to the bend head for bending of a predetermined area of the pipe. The carriage and chuck drive are operated under the command of the control instrumentalities mounted in the console 14, as described in U.S. Pat. No. 3,974,676. When the pipe to be bent has been properly positioned longitudinally and rotationally, the carriage brake is released so that the carriage is freely slidable along the track and bending is commenced, pulling the pipe around the bend die on the bend head and also pulling the carriage forwardly along the track. A section of pipe having a number of completed bends is illustrated in dotted lines in FIG. 1 at 68*a*.

A bend head mounted on support 16 includes first and second die assemblies 70 and 72 positioned on opposite ends of a common bend die shaft 74 so that either right hand or left hand bends may be made by the single machine. To this end the carriage and track are shiftable relative to the bend head support 16 so as to align the track with one or the other of the bend head assemblies. The rearward end of the track, mounted on the control console 14, is also shiftable, being pivoted by simply pivoting the console 14 about its supporting rollers. Details of the track and carriage shifting will be described below.

Principles of the present invention are described herein as applied to rotary bending methods and apparatus that embody a rotary bend die, a clamp die for pressing a forward portion of a pipe to be bent against the bend die and adapted to rotate together with the bend die about the bend axis, and a pressure die for pressing or clamping a more rearward portion of the pipe against the bend die or some other backup member during bend die rotation. In the described arrangement the pressure die is not longitudinally movable (along the pipe axis) but is fixed in position once it has been urged toward the bend die to press the pipe against the bend die and provide a wiping action. This force of the pressure die provides sufficient friction to afford the desired drawing of the pipe (the stretching or axial elongation beyond its yield point).

A significant feature of the described reaction bending is the fact that the force exerted by the pressure die to press the pipe against the backup member, and thus the amount of axial restraint provided by the clamping action of the pressure die, is varied in accordance with the force required to rotate the bend and clamp dies (the force required to bend the pipe).

PREFERRED BEND HEAD

Illustrated in FIGS. 4–13, is a preferred mechanization of principles of the bend head of the present invention. FIG. 3 also illustrates the apparatus of FIGS. 4 through 13, but in a somewhat simplified form and with many of the parts elongated or extended laterally (horizontally) solely for the purpose of better illustrating the functional relation of several of the components. In the preferred mechanization, the bend head support includes a housing 120 (FIG. 1) having a base 122 upon which is fixed an upstanding bend head support comprising a pair of parallel, mutually spaced standards 124, 126 interconnected at their upper ends by a rigid arm 128 having a head 130 in which is journalled a horizontal bend head shaft 132. Slidably mounted upon the posts 124, 126 for vertical reciprocation is a generally rectangular pressure die carrier 134 comprising a pair of mutually parallel and mutually spaced horizontally extending top and bottom plates 136, 138 fixedly connected to each other at their outer ends by vertical end plates 140, 142, respectively. Plates 136 and 138 are formed with laterally outwardly facing grooves that mate with and slide upon the circular cross-section posts 124, 126. Top plate 136 of the pressure die carrier is formed with an elongated opening 137 and first and second apertures 139, 141 (FIG. 8) to permit relative vertical motion of the pressure die carrier and other parts of the bend head as will be described below. Fixedly secured to the bottom plate 138 is a cylinder 146 of an hydraulic motor generally indicated at 148 and having a piston rod 150 extending through a hole in plate 138 and carried on a piston 152 slidably mounted in the cylinder.

Figure 10:
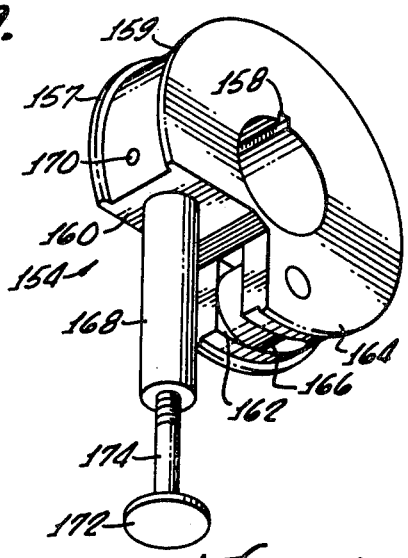
FIG. 10 is a perspective view of one bend shaft actuator of the bending machine of FIG. 4.
Figure 11:
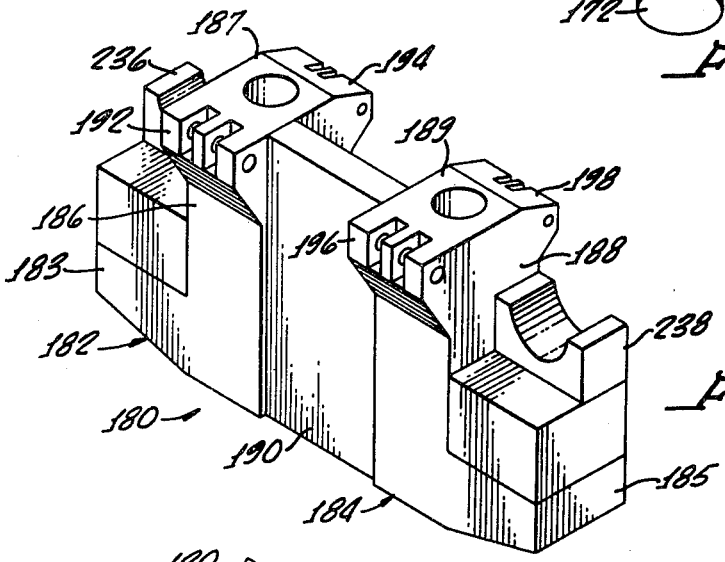
FIG. 11 is a perspective view of the clamp die carrier of the bending machine of FIG. 4.

Fixedly mounted on the bend die shaft 132, symmetrically disposed on either side of and adjacent the standard head 130, are first and second substantially identical shaft actuators 154, 156, certain details of which may be best seen in the perspective illustration of FIG. 10. Actuator 154 is apertured to receive the rotary bend die shaft 132 and is keyed thereto by means of a key in a keyway 158 and a mating keyway formed in the shaft 132. The actuator, which is formed as a nearly circular plate, has a segment thereof cut away to provide a drive or abutment surface 160 extending substantially radially of the actuator, in a plane parallel to the bend die shaft axis, and has a pair of axially spaced radially extending flanges 162, 164 between which is journalled a guide roller 166.

A bore formed in the actuator and extending perpendicular to the drive surface 160, along a line perpendicular to the bend axis and spaced therefrom, receives a guide shaft 168 which is fixed to the actuator by means of a pin or set screw 170. Shaft 168 has a large headed screw or washer 172 adjustably connected thereto by means of a shank 174 that is threaded into the free end of shaft 168.

Figure 9:
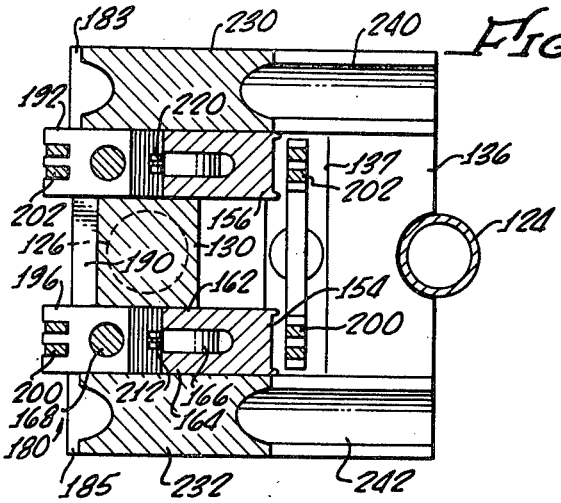

A clamp die carrier 180 (shown in pictorial form in FIG. 11) is movably mounted upon the shaft actuators 154, 156, being slidably guided upon the shafts 168 to move toward and away from the actuators. The clamp die carrier comprises a pair of opposite hand L-shaped end blocks 182, 184 respectively, having horizontal legs 183, 185, and vertical legs 186, 188. The L-shaped end blocks are fixedly connected to each other in mutually spaced relation by a plate 190 which is positioned closer to a forward face of the aligned and mutually opposed end blocks 182, 184. The vertical legs of the end blocks each has secured to opposite sides thereof furcated chain connectings lug 192, 194 and 196, 198. Each of the vertical legs of the clamp die carrier end blocks is provided with a bore extending entirely through the leg and slidably receiving the guide shafts 168 of the respective shaft actuators 154, 156. Motion of the clamp die carrier away from the shaft actuators (downwardly) is limited by abutment of the lower end of the carrier with the head or washer 172 fixed to the screw shank 174 that is adjustably carried on the shaft 168. Motion of the carrier toward the actuator is limited by abutment, in driving engagement, between the upper end 187, 189 of each vertical leg 186, 188 of the respective clamp die carrier end blocks and the drive surfaces 160. Counterclockwise rotation of the clamp die carrier 180, and thus of the shaft actuator 154, 156 and shaft 132, is limited by abutment of the rear surface of intermediate plate 190 (the surface closer to lugs 194, 198) with the vertical outward surface of the post head 130 (FIG. 9).

A pair of drive chains 200 and 202 each has one end thereof connected to one of the chain connecting lugs 196, 192 on the front of the clamp die carrier, each chain extending in slidable, non-driving relation around the periphery of a respective one of the shaft actuators 154 and 156 between upstanding chain guiding circumferential lips 157, 159 thereon. The other ends of the chains 200, 202 are connected respectively to upper ends of a pair of arms 204, 206 of chain yoke 208 having a cross member 210 that is connected at its center in driven relation to the upper end of cylinder rod 150.

Connected to the chain lug 198 of the clamp die carrier is one end of a return chain 212 that is guided first over roller 166 mounted in shaft actuator 154 and thence over a roller 214 journalled on a shaft 215 at an upper portion of the forward post 126 of the standard (FIGS. 6, 7). The return chain extends downwardly, thence around a roller 216 which is journalled on a collar 218 fixed to the post 126. From roller 216 the return chain extends upwardly for connection to the lower end of the end arm 204 of yoke 208.

At the other side of the bending head, a similar return chain 220 is provided, having one end connected to the chain lug 194 of the clamp die carrier, thence being guided over a roller 222 (analogous to roller 166) that is journalled in the shaft actuator 156. Chain 220 then extends over a second roller 224, also journalled on the shaft 215 that is carried at the upper end of post 126 and which mounts roller 214 on the other side of the post. Return chain 220 extends downwardly to and over a roller 226 journalled on the other side of fixed collar 218 and thence upwardly for connection to the end arm 206 of yoke 208. Chain yoke 208, portions of the return chains 212 and 220 connected thereto, and piston rod 150 are all positioned to move vertically through the slot 137 of the upper plate of the pressure die carrier. Forward portions of the return chains 212 and 220, those portions closer to the clamp die carrier, extend through the apertures 139 and 141 respectively of the upper plate of the pressure die carrier (FIG. 8). In each case, on each side of the bend head standard, the combination of drive chain and return chain, connected to each other through the drive yoke 208, in effect forms a single endless chain connected at its ends to the respective front and back chain lugs 196, 198 for the one side of the bend head and chain lugs 192, 194 for the other side.

First and second bending die assemblies are mounted on opposite sides of the bend head. The assemblies are substantially identical to each other, and being on opposite sides of the bend head, permit both right hand and left hand bending, or bending on different radii (using different size dies), as will be more particularly described below. Thus first and second bend dies 230, 232 are detachably mounted on opposite ends of the bend shaft 132, each being connected to rotate with the shaft by means of a detachable dowel or a key, such as key 234 of FIG. 4.

First and second clamp dies 236, 238 are detachably mounted on ends of the horizontal legs 183, 185 of the clamp die carrier 180 and are laterally registered to the carrier by suitable means, such as, for example, interengaging bores and dowels or grooves and lugs, or the like (not shown). Similarly, first and second pressure dies 240, 242 are detachably mounted on opposite ends of the pressure die carrier upper plate 136 and laterally registered thereto by interengaging dowels and bores or lugs and grooves, or the like (not shown).

To provide a continuous and substantially constant upward force on the entire hydraulic motor 148, an auxiliary motor or hydraulic cylinder 250 is connected between the bottom of the primary motor cylinder 146 and the bottom plate 122 of the bend head support. Such an auxiliary cylinder may be separate from, though connected to, the cylinder 146. It may be combined with the cylinder 146, as illustrated in FIG. 6, wherein the lower end of the primary cylinder 146 is extended downwardly to provide a secondary cylinder 252 in which is mounted an auxiliary piston 254, having a piston rod 256 extending downwardly from the cylinder into engagement with the bottom plate 122. The auxiliary cylinder 250 provides a steady upward force on motor 148, which force is slightly greater than the weight of the pressure die carrier and dies thereon. This cylinder, therefore, can be replaced by a compression spring.

BENDING OPERATION

The bending head is in the position shown in FIGS. 4, 5, 6 and 7 prior to the start of a bend. The weight of the pressure dies and the pressure die carrier is more than balanced by the upward force continuously exerted by auxiliary motor 250. The primary motor is energized in a return mode to drive the cylinder 146 downwardly, overcoming the force of the auxiliary motor, and maintaining the pressure and clamp dies in retracted position. The bend shaft and the clamp die carrier are in a limit position of maximum counterclockwise rotation (as viewed in FIGS. 4 and 6), which position is limited and defined by abutment of the intermediate plate 190 of the clamp die carrier with the front vertical face of the post head 130 (see FIG. 9). A pipe 68 to be bent is grasped in the chuck 60 (FIG. 2) and, by operation of the carriage and rotation of the chuck, is positioned longitudinally and rotationally relative to the assembly of dies that are to be used for this bend. Dies 232, 238 and 242 are used in this example. Energization of primary motor 148 is reversed to transmit hydraulic fluid under pressure to the upper portion of the cylinder 146, above piston 152, thus tending to drive the piston and piston rod downwardly and reacting against cylinder 146 to urge the latter upwardly. The two equal and opposite drives, that of the movable piston rod and that of the movable cylinder, operate against different resistive forces. That one of the two equal and opposite drives which is exerted against the lesser resistance will first effect motion. In the illustrated embodiment, resistance to upward motion of the cylinder 146 is less than resistance to the downward motion of the piston rod 150 at this point because the weight of the primary motor, the pressure die carrier and pressure dies is more than balanced by the auxiliary motor 250. In fact, the latter alone provides enough force to raise the pressure die and its carrier together with the primary motor. The weight of the clamp die carrier 180, which must be raised by downward motion of the piston rod, resists such piston rod motion.

Initially the cylinder 146 moves upwardly, raising the pressure die carrier and pressure die through the small space between the pressure die and the bend die (which may be in the order of three-quarters of an inch or less) and raising the forward end of the pipe to be bent toward the bend die. This produces a relatively light pressure, urging the pipe against the bend die, and the parts are in the position illustrated in FIG. 12, with the clamp die and clamp die carrier still in retracted position. Application of hydraulic fluid to the primary motor is steady and as it continues, resistance to further upward motion of cylinder 146 increases because the pressure die is now contacting the pipe and urging it against the bend die, which cannot move in this direction. When this resistance to further upward motion of the cylinder becomes greater than the resistance afforded by the clamp die carrier to upward motion on its sliding connection with the shaft actuators, the carrier 180 moves upwardly, die 238 contacts the pipe and begins to clamp the pipe against the bend die (as shown in dotted lines in FIG. 12).

Hydraulic pressure continues to build up within the primary motor, exerting an increasing force, which urges the piston downwardly and the cylinder upwardly. Thus the force of the pressure die, pressing the pipe against the bend die, increases and the force of the clamp die carrier and clamp die against the pipe and bend die and against the shaft actuators increases. The clamp die forces the pipe into the mating cavities of the bend and clamp dies and at this point the upper surfaces 187, 189 of the clamp die carrier may abut the downwardly facing drive surface 160 of actuator 154 and the corresponding drive surface of actuator 156. As resistance to relative movement of the hydraulic motor parts increases, the forces provided by the motor increase and the bend shaft 132 begins to rotate, carrying the clamp die carrier, the clamp die, and the forward end of the pipe with it, bending the pipe and pulling the pipe around the bend die toward the position illustrated in FIG. 13.

The motor force builds up to a magnitude sufficient to rotate the bend die and bend the pipe. Thus both the downward force on the piston rod and the reaction thereto, which urges the cylinder 146 upwardly, also increase. The force urging the pressure die toward the bend die increases in accordance with the increase in force required to bend the pipe. As the pipe is bent around the bend die, it is pulled through the constricting mating cavities of the pressure and bend dies with a wiping action that provides an axial restraint sufficient to draw the pipe. As the bending force increases, the force exerted by the pressure die increases and thus the frictional force and axial restraint increase, requiring still greater force to rotate the bend die. The several forces rapidly balance themselves since the hydraulic pressure is of sufficient magnitude to overcome any of the resistances. The bend is completed with the pipe being bent and pulled around the bend die while the pressure die exerts a pressure on the pipe, pressing it against the bend die, with a force that (at least up to a limit which may be provided by contact between pressure and bend dies) is a function of the force required to rotate the bend and clamp dies.

The pressure die is mounted so that it moves toward the pipe along a path (parallel to posts 124, 126) that at least has a component directed radially of the bend die (e.g., non-tangential). This permits the pressure die to develop a frictional restraining force of the proper magnitude. Preferably the pressure die is positioned so that the force it exerts upon the pipe is directed along a line displaced to the rear of the bend axis, substantially normal to the pipe (see FIGS. 12, 13).

Figure 13:
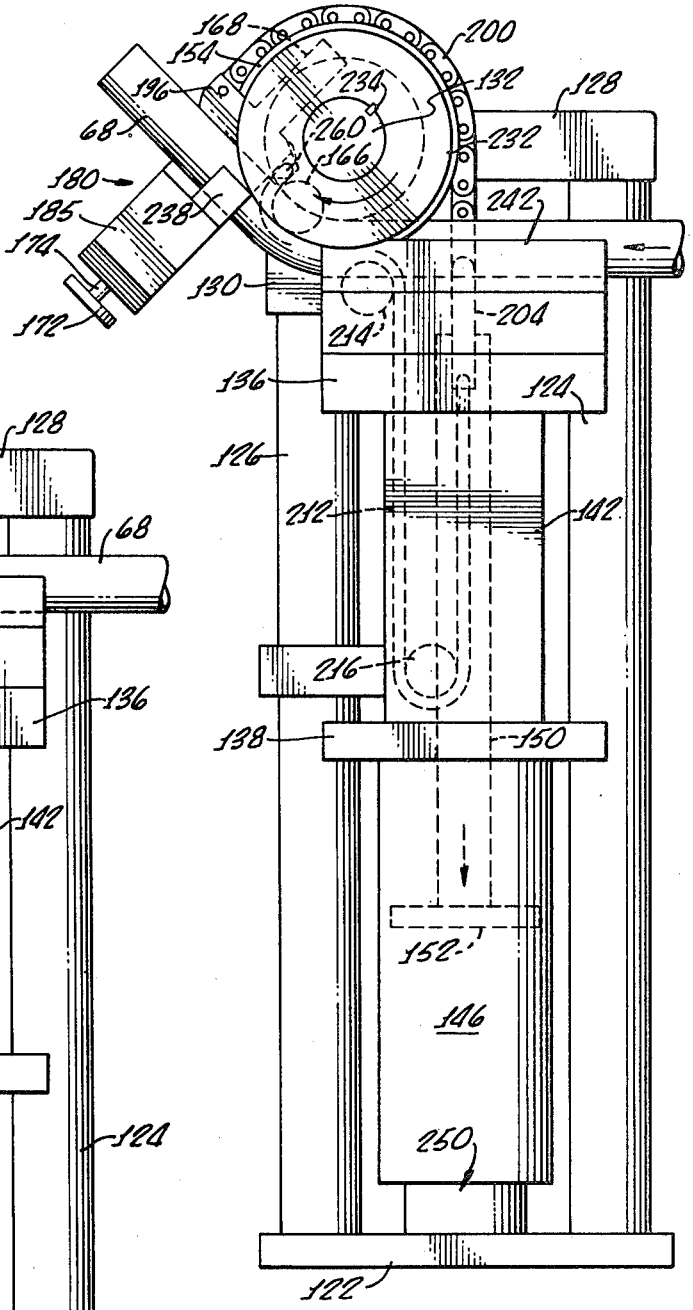
FIG. 13 is a view similar to FIG. 12 showing the position of the dies after bending has begun.

Upon completion of the bend, the parts may be in a position such as illustrated in FIG. 13, for example. To return to the home position of FIG. 4, the motor drive is reversed in direction, applying pressure to cylinder 146 below the piston to urge the piston rod upwardly and cylinder downwardly. Tension on the return chain 212 exerts a force upon the clamp die carrier 180 that is nearly radially directed relative to the bend shaft, being substantially parallel to the axis of the shaft guide 168, and also exerts a moment about the axis of shaft 132 by reason of contact of the chain with roller 166. However, this moment is initially resisted by the friction between bend die and pipe. The latter is still urged against the bend die by the auxiliary motor which exerts its constant force that is sufficient, at this time, to overcome the relatively small return force tending to drive cylinder 146 downwardly. When the clamp die carrier 180 is displaced from the shaft actuators 154, 156, tension on the return chain exerts a force on the clamp die carrier that is directed at an angle with respect to the axis of the guide shafts 168 of the shaft actuators 154 and 156 and along a line displaced from the bend shaft axis. Further, the return chain still engages the actuator mounted roller 166 and thus continues to exert a returning moment on the actuator. Thus during the return stroke, tension of the return chain tends to move the carrier relative to the actuators in which it is slidably mounted and, when the carrier reaches the end of its displacement, which displacement is limited by abutment with the washer 172 carried by the shaft 168, the return chain rotates the shaft actuators and shaft 132 in a counterclockwise direction, as viewed in FIG. 13. The clamp die carrier, having reached the limit of its outward displacement from the shaft actuators, can be displaced no further and thus the pull exerted by the return chain upon the carrier cannot further displace the carrier but can only rotate the carrier together with the shaft actuators.

When the clamp die carrier can be displaced no further from the shaft actuators, tension of the return chain overcomes the frictional restraint against rotation of the bend shaft and the latter rotates in a counterclockwise direction toward the home position. When the clamp die carrier reaches this home position, its inner face abuts the forward face of the post head 130 whereby resistance to further upward motion of the piston rod greatly increases. Now the reactive force on the cylinder drives the cylinder, pressure die carrier and pressure die downwardly, overcoming the force of auxiliary cylinder 250, and all of the parts are back to the home position. At this time, or before the return to home position has been completed, the carriage and chuck controls are again actuated to advance the pipe and rotate it for the next bend.

The described apparatus employs a single motor to exert a force directly upon the clamp die and, by means of a lost motion connection, to exert an equal force upon the bend die. The lost motion connection comprises the connection between the piston rod and the clamp die carrier and the slidable connection of the carrier to the bend die. This enables the carrier to move toward the bend die for a short distance before it engages the actuator to effect rotation thereof.

The same force that is provided by the motor to drive the clamp and bend dies produces a reaction force that drives the pressure die toward the bend die. Thus the one motor provides a drive to all three of the bending dies—the bend die, the clamp die and the pressure die. Even though each of these dies moves in its own unique motion at its own unique time, the interconnections are such that all of these motions are provided by the one motor. Three different motions are provided by the one motor by using a direct connection and a lost motion connection between one part of the motor and two of the driven elements (the clamp die and the bend die, respectively) and by movably mounting the entire motor with the other motor part being connected to the third driven element (the pressure die).

A surprising and unexpected advantage of driving the pressure die with the reaction to the bending force is that an axial restraint is exerted on the pipe which is a function of the bending force. This is not merely reacting a central bending force against a pair of opposed flanking resistances, as in simple press bending. It enables a bending in which axial restraint of the pipe, or pipe elongation, is achieved as a function of applied bending force. The pressure die force is automatically adjusted for the actually exerted bending force. This eliminates need for the prior art practice of attempting to monitor the pressure die force and to manually or otherwise adjust it for different types of pipe to be bent. Moreover, an optimum, self-balancing adjustment of the frictional tensioning force relative to the bending force is achieved. Benefits of this operation are significant.

It will be readily appreciated that different bending forces are required for pipes having different diameters, wall thicknesses, or materials. The greater the modulus of the elasticity or the greater the wall thickness or the greater the pipe diameter, the greater the force required to bend the pipe. At the same time, if a greater force is required to bend the pipe, a greater force will be required to stretch the pipe. Thus where a wiping action is employed, or other means such as a tight internal mandril is employed to restrain axial motion of a rearward portion of the pipe to effect stretching, this axial restraint must be greater for a pipe that has a larger diameter, a larger wall thickness, or a higher modulus of elasticity.

Further, the relation is not a simple one since the force required to rotate the bend die and thus pull the pipe around the bend die, depends not only on the resistance of a given pipe to bending per se, but also it depends upon the resistance of a given pipe to axial stretching. In rotary draw bending, the force required to rotate the bend die is a function of both the pipe bending resistance and the pipe resistance to stretching. With the described reaction bending, where the force exerted on the pressure die is a function of the applied bending moment, it is not necessary to monitor the applied tension, to monitor the force exerted by the pressure die, nor to adjust the force exerted by the pressure die. The pressure die force and the applied tension or frictional restraint created thereby are both adjusted automatically. In fact, it has been found that certain pipes capable of being bent to no less than a four inch radius on a conventional rotary draw bending machine, can be bent to a smaller radius on the machine described above.

The maximum amount of pressure exerted by the pressure die upon the pipe may be limited by so dimensioning the parts that as the pressure die approaches the bend die, it will contact the bend die, or some other backup structure, after pressing against the pipe to force it into both the bend and pressure die cavities. The parts may be so configured that the pressure die at some point in its motion toward the bend die will actually contact the bend die and, when this contact has occurred, the force exerted by the pressure die upon the pipe can no longer increase. Thus, with such an arrangement, force exerted by the pressure die upon the pipe (to frictionally restrain and axially tension the pipe) will increase up to a certain point (as the bending force increases) and then remain constant, even if the bending force increases further.

Similarly, the pressure exerted by the clamp die upon the pipe may be caused to increase up to a point at which the clamp die carrier engages the drive surface of the shaft actuators, thereby preventing any further increase in the clamping pressure exerted on the pipe by the clamp and bend dies.

In general, the clamping forces exerted on forward and rearward portions of the pipe, namely the clamping force exerted by the operation of the clamp die on a forward portion of the pipe and the clamping force exerted by the pressure die on a rearward portion of the pipe, are controlled so that draw bending occurs. However, the amount of drawing (e.g., the amount of actual permanent elongation or stretch of the pipe) can be controlled by controlling the maximum light of force applied by the pressure die to the pipe. At one extreme, the pressure and bend dies may be arranged so that contact between these never occurs, whereby the force exerted by the pressure die is at all times a function of the bending force. At an opposite extreme, the maximum force exerted by the pressure die and the pipe may be very light if the increase of such force is limited by an early engagement of the pressure die with the bend die as the pressure die is urged toward the pipe. In such an arrangement, although the pressure die guides the pipe and provides some frictional restraint, it may exert insufficient pressure to create any drawing and thus pure compression bending may be carried out.

In most applications that are presently contemplated, the dies are arranged such that drawing of the pipe will commence at the beginning of the bend die rotation. However, since at this beginning of rotation neither bending force nor pressure die force has been built up to its maximum value, a lesser axial restraint is placed on the rearward section of the pipe by the pressure die clamping action. Thus a lesser degree of axial elongation or pipe stretching occurs initially. As the bending force increases, the clamping force of the pressure die increases to thereby increase the axial restraint of the pipe. This, in turn, automatically commands a greater bending force and thus the forces build up so that a greater stretching of the pipe occurs during later portions of the bend. It will be seen that there is a complex relation between the bending force and the force required to be exerted by the pressure die for a desired amount of pipe elongation. The described apparatus, in effect, automatically determines this relation and automatically adjusts the forces accordingly. It is also contemplated that this relation be determined mathematically or empirically, or through a combination of such methods, so that the actually applied bending force can be sensed and its sensed magnitude can be used for generation of a pressure die driving force (e.g., an axial tensioning force) that is some predetermined or precalculated function of the sensed bending force. Such tensioning in response to bending force could be achieved, alternatively, by restraint of the pipe handling carriage or by control of pipe advancing feed rollers of the type described in my co-pending application for Tube Manufacturing and Bending System, Ser. No. 885,329 filed Mar. 10, 1978, the disclosure of which is incorporated herein by this reference. Further, if deemed necessary or desirable, a booster cylinder may be provided to drive the pressure die forward as the pipe is pulled around the bend die to thereby decrease the wiping action and, accordingly, to decrease the axial restraint afforded thereby.

Another significant feature of the described arrangement, a feature which is not necessarily dependent upon use of a reaction principle, is the application of a single drive member, such as the piston rod 150, to both drive the clamp die into clamping relation with the bend die and to rotate the bend and clamp dies together. This is achieved by connection of the motor element, piston rod 150, directly to the clamp die (by means of chains 200, 202 and carrier 180) and indirectly, by means of a lost motion connection, to the bend die (by means of the interengagement of the clamp die carrier and the bend die shaft actuators). This permits the clamp die to partake of its initial separate motion as it approaches the bend die to firmly clamp the pipe, and then to move together with the bend die as the two rotate about the bend axis.

Still another feature of the invention, not necessarily dependent upon the reaction principle, is a compact arrangement that will be described more particularly below for mounting substantially similar or identical sets of bending dies on opposite ends of a common bend shaft so that either right or left hand bends may be made upon a pipe carried by a carriage that is shiftable relative to the dual bend head.

A major function of the auxiliary motor 250 (or a functionally equivalent compression spring) is to provide a relatively light, steady state force, urging the primary motor, the pressure die and pipe toward the bend die. This creates a friction between the pipe and the dies that tends to restrain rotation in one direction or the other of the bend shaft and of the dies and actuators thereon. It will be readily appreciated that this continuous and relatively small frictional resistance to rotation of the bend shaft could be obtained by means other than the auxiliary cylinder or a spring. For example, rotation restraining friction may be introduced in the bearings of the bend shaft, upon the shaft itself, or upon any member fixed to the shaft. Thus one could mount within the post head 130 a brake shoe that bears upon the shaft 132 and is urged against the shaft by a suitable spring to provide adequate frictional restraint against the shaft rotation. With use of such a brake shoe, the auxiliary motor 250 could be eliminated. Eliminating auxiliary motor 250 and utilizing a steady frictional restraint against rotation of the bend shaft (which restraint is not nearly enough to significantly resist the rotational drive of the primary motor) involves a slightly different sequence of operations at the beginning of a bend. No steady force is provided to balance the weight of the primary motor and pressure die carrier. Initially driving the piston rod downwardly and the cylinder upwardly from the home position, the weight of the pressure die carrier and primary motor may provide greater resistance than the weight and friction involved in motion of the clamp die carrier toward the bend die. Therefore, the latter will move upwardly before the pressure die (in the absence of the auxiliary motor). However, the frictional restraint on rotation (by a frictional shoe or the like) provides resistance to further (rotary) motion of the clamp die carrier (together with the bend shaft) sufficient to insure that the pressure die is pressed against the pipe and toward the bend die before rotation commences. Further, the resistance of the pipe to being bent would insure that the pressure die is urged toward the bend die with an adequate force before actual rotation commences.

Although it is presently preferred to provide clamping action upon the rearward portion of the pipe by driving the pressure die toward the bend die to clamp the pipe between the pressure and bend dies, it will be readily appreciated that an additional member, other than the bend die itself, may be provided to act as a backup which resists the force exerted by the pressure die upon the pipe. Thus the pressure die may cooperate with such other fixed backup member (which may be termed a "wiper die") to press the pipe against such wiper die. The pressure die may also contact such wiper die to limit the amount of force that the pressure die can apply against the pipe.

The specific mechanization disclosed herein employs a pair of bend die assemblies on either side of a central post. However, where the flexibility of right and left hand bending may be dispensed with, and where unusually heavy bending is to be performed, the apparatus may be rearranged to employ a single centrally located assembly of bending dies. Thus the bend shaft may be supported at its two outer ends in a pair of journals mounted on laterally spaced standards. A single bend die may be fixed to an intermediate point of the shaft and flanged by a pair of shaft actuators, fixed to the shaft and which cooperate with a clamp die carrier in the manner previously described. Similarly, a pressure die carrier and pressure die of the type previously described would be mounted on the posts for cooperation with a single centrally located bend die.

SHIFTING CARRIAGE

Figure 14:
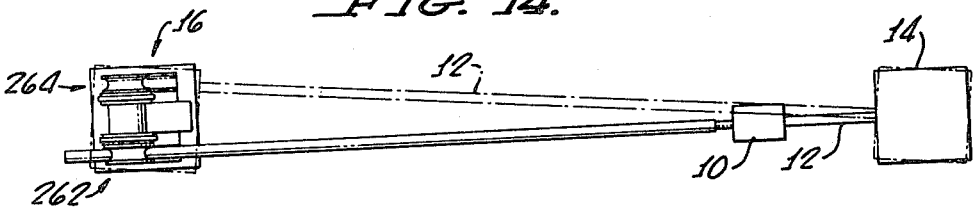
FIG. 14 is a plan view of the machine illustrating the shifting of the pipe feeding carriage and carriage track relative to the bend head.
Figure 5:
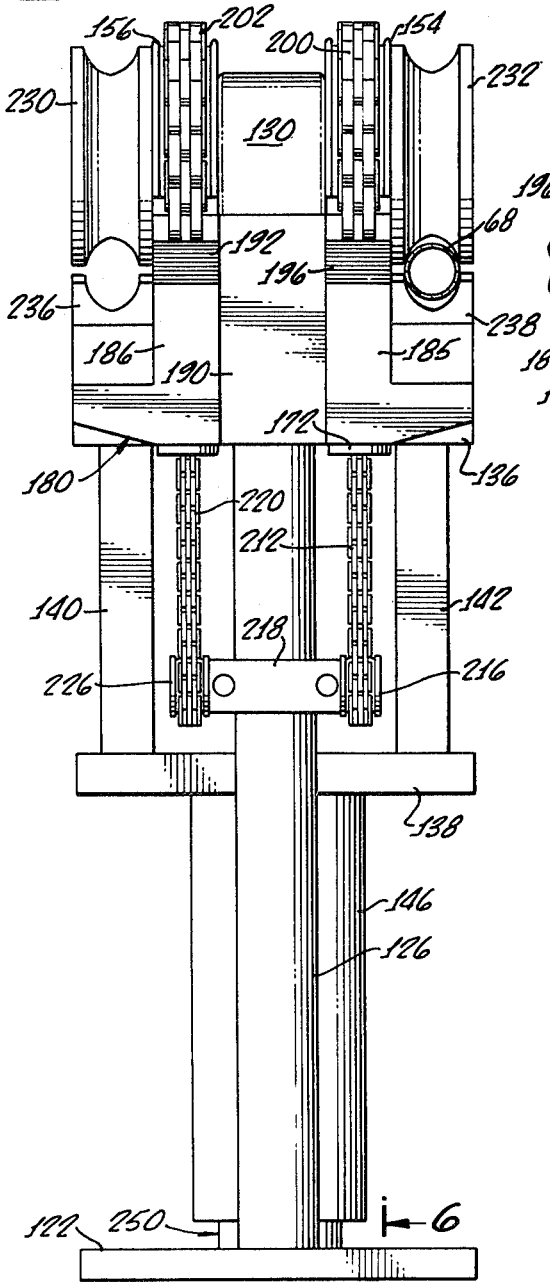
FIG. 5 is a front view of the bending head of FIG. 4.
Figure 4:
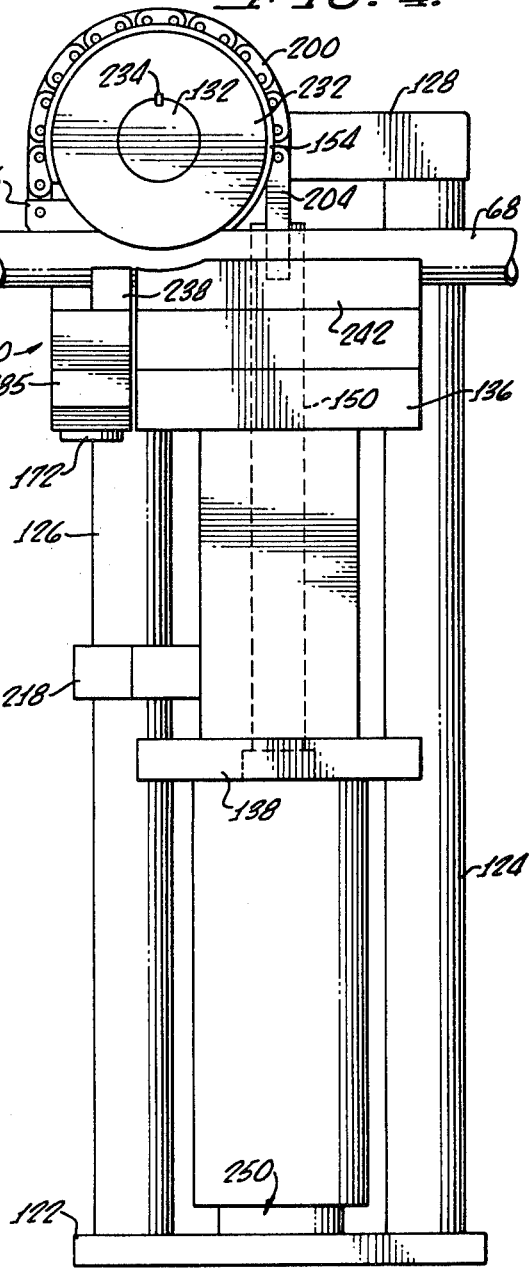
FIG. 4 is a side elevation of a bending head constructed in accordance with principles of the invention.

As described above, the bend head is provided with two substantially identical die assemblies so that either right hand or left hand bends may be made. Alternatively the dies of the two die assemblies may be of different sizes to permit bending on different radii. To permit alternative use of the two assemblies, the carriage is mounted for motion along either one of first and second carriage paths that are aligned respectively with the first and second bend die assemblies. Thus, as can be seen in the schematic illustration of FIG. 14, the console 14 which supports the rear end of track 12, is mounted for limited pivotal motion about a vertical axis as, for example, by being mounted on rollers. The forward end of the track 12 is detachably connected to the bending head support 120 in either one of two positions. A first position is illustrated in solid lines in FIG. 14 in which position the track is aligned with the first assembly of bend dies, indicated at 262. The forward end of the track is detachably connected to the support 16 so that it may be moved to a second position in alignment with the other bend die assembly 264. To achieve this alignment, the bend head support is also mounted for limited pivotal motion about a vertical axis, as for example, by being mounted on rollers (not shown).

Figure 15:
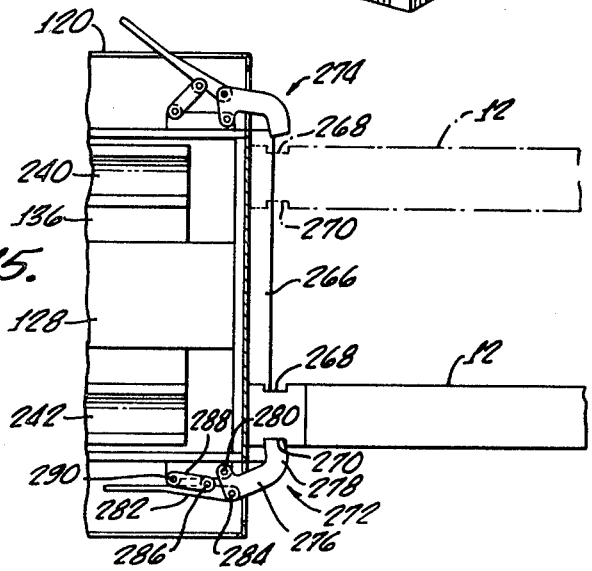
FIG. 15 shows the clamp assemblies for connecting the pipe feeding carriage track to the bend head.
Figure 12:
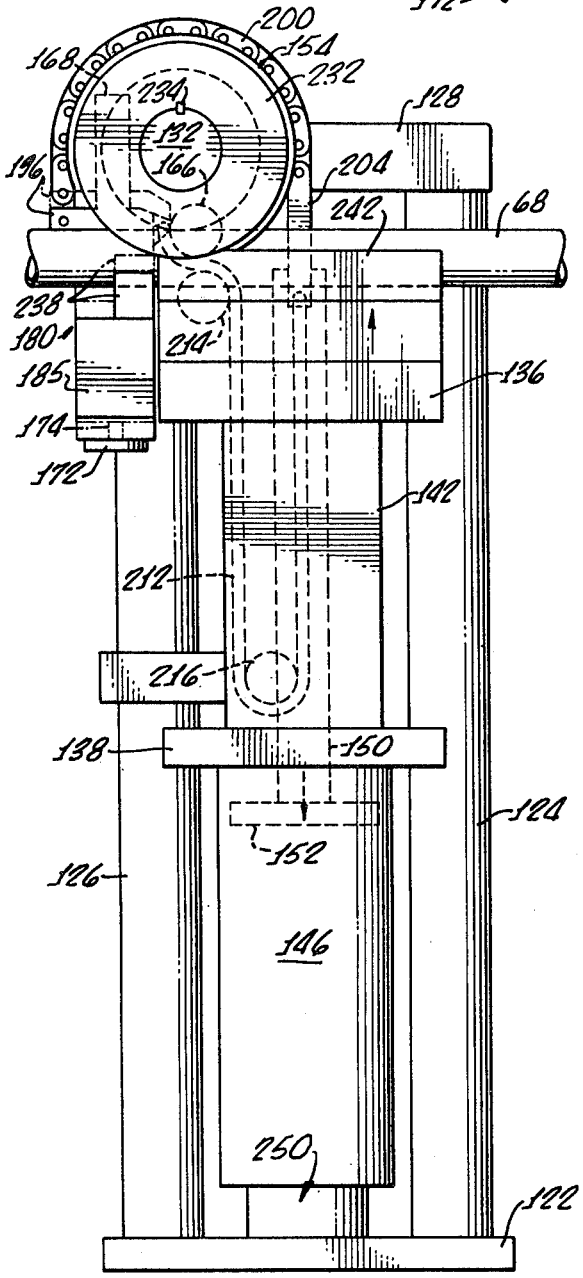
FIG. 12 is a side elevation of the bending head at the start of a bend, with the pressure die in position to commence bending rotation, and with the clamp die shown in both retracted (solid lines) and bending (dotted lines) positions.

Any one of a number of well known means may be employed to detachably connect the forward end of the track to different portions of the bend head support. One such arrangement is illustrated in FIG. 15, wherein the track 12 rests on a horizontally extending shelf 266 that extends across the rear face of the support 120 and is formed with oppositely disposed notches 268, 270 on opposite sides thereof. First and second mutually identical clamps 272, 274, are mounted on the bend head support to detachably lock the forward end of the track in either one of the two positions illustrated in solid and dotted lines respectively in FIG. 15. Clamp 272 comprises a first bellcrank lever 276, having a clamping arm 278 adapted to enter the slot 270 in the end of the track and pivoted at 280 to the bend head support 120. A manual operating lever 282 is pivoted at 284 to the bellcrank 276 and is also pivoted at 286 to a short toggle link 288 which has its other end pivoted at 290 to the support 120. An over center action is provided in which clockwise rotation of the handle lever 282 (as viewed in FIG. 15) will lock the clamp and firmly press the end of the track 12 against the support 120, whereas a counterclockwise rotation of the handle will pivot the bellcrank 276 in a clockwise direction about pivot 280 to release engagement of the clamp. Upon release of this engagement, the end of the track 12 may simply be shifted to the other side of the support 120 and the clamp 274 is then engaged to lock the track in alignment with the dies on the other side of the bend head. To accomplish the necessary alignment, both the console 14 and bend head support 16 are slightly pivoted about vertical axes, previously mentioned.

Although pivotal motion of the track, console and bend head support to accomplish the transverse shifting of the track from one bend die assembly to the other has been illustrated and is presently preferred, it will be readily appreciated that the entire track and its rear support may be transversely shifted without pivotal motion to accomplish a functionally equivalent result.

There have been described methods and apparatus for bending pipe in which a single motor drives all of the dies, having a direct connection to the clamp die, a lost motion connection to the bend die, and a reactive connection to the pressure die. The arrangement automatically adjusts the relation of bending and pressure die forces and provides a simplified unitary drive of both the clamp die and the rotary bend die by the single driving member. The described bend head is illustrated in an arrangement having a pair of bend die assemblies together with a shiftable pipe handling carriage that enables pipe to be bent on either side of the bend head.

The foregoing detailed description is to be clearly understood as given by way of illustration and example only, the spirit and scope of this invention being limited solely by the appended claims.

What is claimed is:

1. A method of bending comprising clamping a forward portion of a member to be bent against a rotary bend die, exerting a bending force on said bend die to effect rotation thereof, so as to pull the member around the bend die and applying frictional restraint to said member by clamping a rearward portion thereof with a force that is a function of said bending force that pulls the member.

2. The method of claim 1 wherein said step of applying restraint comprises forcing a pressure die against said member and toward said bend die to clamp said rear portion between said pressure and bend dies.

3. The method of claim 2 wherein said step of forcing said pressure die comprises transmitting to said pressure die a force that is a reaction to said bending force.

4. The method of claim 1 wherein said first mentioned clamping comprises exerting said bending force upon a clamp die to drive the clamp die toward said bend die and to rotate said bend and clamp dies.

5. The method of claim 1 wherein said frictional restraint is sufficient to draw said member as it is bent.

6. A method of bending pipe comprising clamping a forward portion of a pipe to be bent against a rotary bend die, exerting a bending force on said bend die to effect rotation thereof, so as to pull the pipe around the bend die and applying to a rearward portion of said pipe an axial restraining force that is a function of said bending force that pulls the pipe.

7. The method of bending pipe comprising clamping a first portion of a pipe to be bent between rotary bend and clamp dies, employing a bending force to rotate the bend and clamp dies so as to pull the pipe around the bend die, and pressing a second portion of the pipe toward another member with a force that is a function of the bending force that pulls the pipe so as to frictionally restrain and axially tension the pipe while the bend and clamp dies are rotated.

8. The method of claim 7 wherein said step of pressing a second portion of the pipe comprises employing a reaction to the bending force to press said second portion of the pipe against said other member.

9. The method of claim 7 including the step of employing said bending force to press the clamp die toward the bending die.

10. In a bending machine wherein a bend die is rotatably mounted on a support and a clamp die is movably mounted for motion toward and away from the bend die and for rotation with the bend die to clamp a pipe to be bent between the clamp and bending dies, the method of operating the clamp and bend dies comprising employing a single drive means to both shift the clamp die toward the bend die and to rotate the bend and clamp dies.

11. The method of claim 10 wherein said step of employing a single drive means comprises driving the clamp die toward the bend die and causing the clamp die to exert a rotational force upon the bend die.

* * * * *